United States Patent [19]

Shiraishi et al.

[11] Patent Number: 4,970,888

[45] **Date of Patent: * Nov. 20, 1990**

[54] METHOD OF CHANGING WORKPIECE HOLDERS FOR PRESS MACHINE

[75] Inventors: Motoatsu Shiraishi; Masaru Sasagawa; Ken Tazou; Ryoichi Kageyama, all of Saitama, Japan

[73] Assignee: Honda Giken Kogyo Kabushiki Kaisha, Tokyo, Japan

[ * ] Notice: The portion of the term of this patent subsequent to Sep. 19, 2006 has been disclaimed.

[21] Appl. No.: 125,162

[22] Filed: Nov. 25, 1987

[30] Foreign Application Priority Data

Jan. 9, 1987 [JP] Japan ..... 62-2876

[51] Int. Cl.[5] ..... B21D 43/00; B21D 37/04; B21J 13/08

[52] U.S. Cl. ..... 72/405; 72/422

[58] Field of Search ..... 72/405, 422, 448, 446; 198/621; 414/752; 100/207, 229 R

[56] References Cited

U.S. PATENT DOCUMENTS

| | | | |
|---|---|---|---|
| 3,149,712 | 9/1964 | Soman . | |
| 3,190,464 | 6/1965 | Johansen et al. | 100/207 |
| 3,609,843 | 10/1971 | Fiegel, Jr. . | |
| 3,973,427 | 8/1976 | Shirao | 72/448 |
| 4,228,993 | 10/1980 | Cathers . | |
| 4,259,052 | 3/1981 | Imanishi . | |
| 4,428,221 | 1/1984 | Owens . | |
| 4,503,969 | 3/1985 | Baba | 198/621 |
| 4,519,309 | 5/1985 | Feirer et al. | 72/448 |
| 4,555,012 | 11/1985 | Baba et al. | 198/621 |
| 4,557,133 | 12/1985 | Mikusch et al. | 198/621 |
| 4,625,540 | 12/1986 | Yamada . | |
| 4,658,626 | 4/1987 | Yamada . | |

FOREIGN PATENT DOCUMENTS

| | | | |
|---|---|---|---|
| 53-53080 | 5/1978 | Japan . | |
| 57-134224 | 8/1982 | Japan . | |
| 61-226128 | 3/1985 | Japan . | |
| 60-174297 | 9/1985 | Japan . | |
| 61-167225 | 10/1986 | Japan . | |
| 62-238032 | 10/1987 | Japan . | |
| 984873 | 1/1983 | U.S.S.R. | 72/446 |

*Primary Examiner*—Daniel C. Crane

[57] ABSTRACT

A press machine includes at least one mobile bolster movable with respect to the press machine, a plurality of die assemblies mounted on the mobile bolster and arranged in a row at equal intervals, a plurality of handling bars for transferring a plurality of workpieces successively through the die assemblies, one or more workpiece holders detachably mounted on each of the handling bars for holding the workpieces, feed bars for moving the handling bars, lifting/lower units for vertically moving the feed bars, and handling bar gripping devices for gripping the handling bars. A method of changing the workpiece holders comprises the steps of gripping the handling bars with the handling bar gripping devices, releasing the feed bars from the handling bars, elevating the feed bars beyond the die assemblies with the lifting/lowering units, moving the mobile bolster out of the press machine, and detaching the workpiece holders from the handling bars and replacing the workpiece holders with new workpiece holders.

3 Claims, 6 Drawing Sheets

METHOD OF CHANGING WORKPIECE HOLDERS FOR PRESS MACHINE

BACKGROUND OF THE INVENTION

1. Field of the Invention

The present invention relates generally to a method of carrying, from a press machine, handling bars which hold and transfer a workpiece from die to die, and more particularly to a method of replacing workpiece holders detachably mounted on such handling bars with new workpiece holders when dies are changed.

2. Description of the Relevant Art

Japanese Laid-Open Patent Publication No. 57-134224 discloses a press machine having a portal press, and first and second adjacent pressing dies which are mounted on the portal press and disposed along the direction in which a workpiece is transferred. The press machine includes a workpiece supply station located upstream of the first pressing die, with respect to the workpiece transferring direction, for supplying a workpiece to be pressed, and a workpiece stock station located downstream of the second pressing die for temporarily storing a pressed workpiece. Two feed bars are disposed one on each side of the dies and extend in the workpiece transferring direction, the feed bars being movable vertically and in the workpiece transferring direction by suitable means. Between the feed bars, there extend and are connected a plurality of handling bars each having workpiece holders or vacuum cups for holding a workpiece. When the feed bars are moved, these handling bars successively transfers a plurality of workpieces from the workpiece supply station to the first pressing die to the second pressing die finally to the workpiece stock station.

If workpieces are to be pressed to a different shape, the existing dies must be replaced with new dies to effect the new pressing process. The new pressing process also requires replacement of the old workpiece holders or vacuum cups with new ones. Heretofore, there are known two methods of replacing the workpiece holders. According to one method, the handling bars are detached from the feed bars, and then moved out of the press machine for replacing the existing vacuum cups with new vacuum cups. According to the other known method, the handling bars are not carried out of the press machine, and the old vacuum cups are replaced with new vacuum cups within the press machine. However, the former method is of poor efficiency since the handling bars are manually dismounted from the feed bars. The latter method fails to effect a smooth and quick replacement procedure because of a limited space available for replacement in the press machine.

SUMMARY OF THE INVENTION

It is a major object of the present invention to provide a method of changing workpiece holders for a press machine by automatically disconnecting handling bars from feed bars and carrying devices which grip the disconnected handling bars out of the press machine, so that workpiece holders attached to the handling bars can be replaced efficiently and easily within a short period of time.

According to the present invention, there is provided a method of changing workpiece holders detachably mounted on handling bars for holding workpieces in a press machine, the press machine including at least one mobile body, a plurality of die assemblies mounted on the mobile body, and handling bar moving means for moving the handling bars from die assembly to die assembly, the method comprising the steps of gripping the handling bars, releasing the handling bar moving means from the handling bars, elevating the handling bar moving means beyond the die assemblies, moving the mobile body out of the press machine, and detaching the workpiece holders from the handling bars and attaching new workpiece holders to the handling bars.

According to the present invention, there is also provided a method of changing workpiece holders used in a press machine for simultaneously pressing a plurality of workpieces, the press machine including at least one mobile body movable with respect to the press machine, a plurality of die assemblies mounted on the mobile body and arranged in a row along a direction in which the workpieces can be transferred through the press machine, a plurality of handling bars movable by handling bar moving means for transferring the workpieces successively through the die assemblies, lifting/lowering means for vertically moving the handling bar moving means, a plurality of workpiece holders detachably mounted on the handling bars for holding the workpieces, and a plurality of handling bar gripping devices mounted on the mobile body for gripping the handling bars, the method comprising the steps of gripping the handling bars with the handling bar gripping devices, releasing the handling bar moving means from the handling bars, elevating the handling bar moving means beyond the die assemblies with the lifting/lowering means, moving the mobile body out of the press machine, and detaching the workpiece holders from the handling bars and replacing the workpiece holders with new workpiece holders.

According to the present invention, there is also provided a method of changing workpiece holders detachably mounted on handling bars for holding workpieces in a press machine, the press machine including at least one mobile body, a plurality of die assemblies mounted on the mobile body, handling bar moving means for moving the handling bars from die assembly to die assembly, and handling bar gripping devices for gripping the handling bars, the method comprising the steps of gripping the handling bars with the handling bar gripping devices, releasing the handling bar moving means from the handling bars, elevating the handling bar moving means beyond the die assemblies, moving the mobile body out of the press machine, tilting the handling bar gripping devices away from the die assemblies, and detaching the workpiece holders from the handling bars and attaching new workpiece holders to the handling bars.

According to the present invention, there is also provided a method of changing workpiece holders used in a press machine for simultaneously pressing a plurality of workpieces, the pressing machine including at least one mobile body movable with respect to the press machine, a plurality of die assemblies mounted on the mobile body and arranged in a row along a direction in which the workpieces can be transferred through the press machine, a plurality of handling bars movable by handling bar moving means for transferring the workpieces successively through the die assemblies, lifting/-lowering means for vertically moving the handling bar moving means, a plurality of workpiece holders detachably mounted on the handling bars for holding the workpieces, a plurality of handling bar gripping devices mounted on the mobile body for gripping the handling bars, and tilting means for tilting the handling bar gripping devices, the method comprising the steps of gripping the handling bars with the handling bar gripping devices, releasing the handling bar moving means from the handling bars, elevating the handling bar moving means beyond the die assemblies with the lifting/lowering means, moving the mobile body out of the press machine, tilting the handling bar gripping devices away from the die assemblies with the tilting means, and detaching the workpiece holders from the handling bars and replacing the workpiece holders with new workpiece holders.

The above and further objects, details and advantages of the present invention will become apparent from the following detailed description of preferred embodiments thereof, when read in conjunction with the accompanying drawings.

DETAILED DESCRIPTION OF THE PREFERRED EMBODIMENTS

Figure 1:
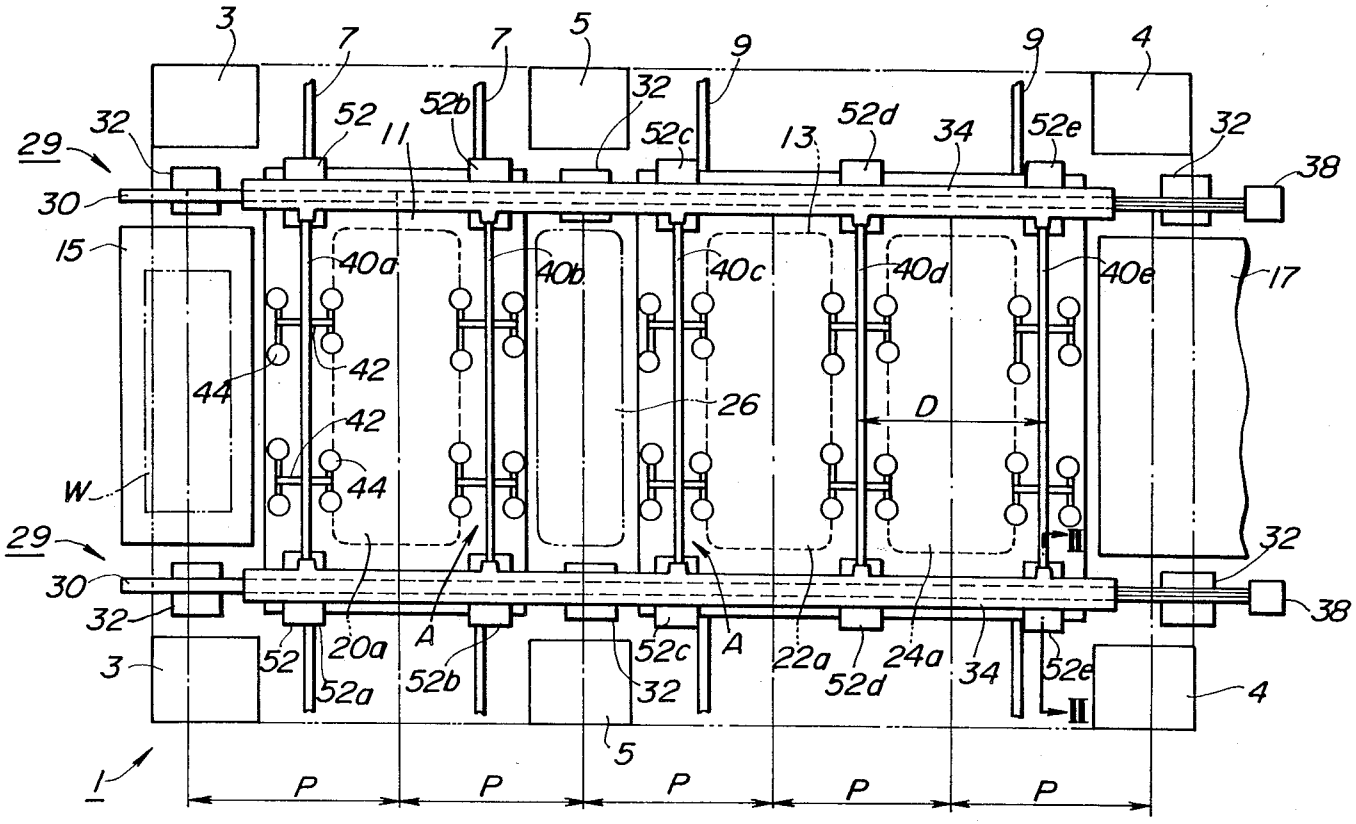
FIG. 1 is a fragmentary plan view of a press machine.

As shown in FIG. 1, a press machine 1 has four upstanding corner columns 3, 4 and two upstanding central columns 5 each positioned between one pair of corner columns 3, 4. A pair of guide rails 7 is disposed between the corner colums 3 and the central columns 5 and extends in a direction normal to the longitudinal direction of the press machine 1, i.e., to the direction in which a workpiece W is transferred. A pair of guide rails 9 is disposed between the corner columns 4 and the central columns 5 and extends in a direction normal to the longitudinal direction of the press machine 1, i.e., to the direction in which a workpiece W is transferred. First and second mobile bolsters 11, 13 are movable along the respective pairs of guide rails 7, 9 into and out of the press machine 1 by suitable drive means. A loading station 15 is located upstream (leftward in FIG. 1) of the first mobile bolster 11 with respect to the workpiece transferring direction. A workpiece W to be pressed is supplied to the loading station 15. An unloading station 17 is located downstream (rightward in FIG. 1) of the second mobile bolster 13 with respect to the workpiece transferring direction. A workpiece W that has been pressed is unloaded from the unloading station 17.

A lower drawing die **20*a* is mounted on the upper surface of the first mobile bolster 11. A lower trimming die 22*a* and a lower punching die 24*a* adjacent thereto are mounted on the upper surface of the second mobile bolster 13. These lower dies 20*a*, 22*a*, 24*a* are arranged in a row along the workpiece transferring direction. A workpiece stock station 26 for temporarily placing a workpiece W thereon is disposed between the first and second mobile bolsters 11, 13 and also between the central columns 5. The longitudinal central lines of the stations 15, 17, 26 and the longitudinal central lines of the lower dies 20*a*, 22*a*, 24*a* on the first and second mobile bolsters 11, 13 disposed adjacent to the respective stations are equally spaced at intervals or distances P. An upper drawing die (not shown) is supported on a die holder (not shown) which is vertically movable along the corner columns 3, 4 and the central columns 5, and an upper trimming die (not shown) and an upper punching die 24*b* (FIG. 7) are supported on respective die holders which are vertically movable along the corner columns 3, 4 and the central columns 5**.

A workpiece transfer device 29 has two vertically movable bars 30 extending along the workpiece transferring direction and disposed between the corner columns 3, 4 and the central columns 5 and the first and second mobile bolsters 11, 13. The vertically movable bars 30 are supported on and vertically movable by a plurality of lifting/lowering units 32. Feed bars 34 are mounted respectively on the vertically movable bars 30 and axially slidable thereon by respective feed bar moving units 38. The vertical movement of the vertically movable bars 30 and the sliding movement of the feed bars 34 are related to the vertical movement of the upper dies through a link mechanism and cams (not shown).

A plurality of handling bars **40*a* through 40*e* extend between and are joined to the feed bars 34 in a ladder-like configuration. Adjacent two of the handling bars 40*a* through 40*e* are spaced from each other by a distance D which is equal to the distance P between adjacent two of the stations 15, 17, 26 and the lower dies 20*a*, 22*a*, 24*a*. A plurality of suction members, i.e., vacuum cups 44 serving as workpiece holders are supported on each of the handling bars 40*a* through 40*e* by means of detachable support members 42 for holding workpieces W under suction. In the illustrated embodiment, a total of eight vacuum cups 44** are mounted on each handling bar.

When workpieces W are pressed, the handling bars **40*a* through 40*e* are located in respective retracted positions A on both sides of the lower dies 20*a*, 22*a*, 24*a* so that the handling bars will not interfere with the pressing operation. After the pressing process has been completed, the upper dies are elevated by the die holders, and then the feed bars 34 and the vertically movable bars 30 are elevated by the lifting/lowering units 32**.

The feed bars 34 are moved to the left in FIG. 1 by the feed bar moving units 38 by a distance (1/2P) which is half the distance P between the central line of the loading station 15 and the central line of the first mobile bolster 11. The leftward movement of the feed bars 34 is followed by downward movement, caused by the lifting/lowering units 32, of the vertically movable bars 30 and the feed bars 34 to a prescribed position. Now, the vacuum cups 44 mounted on the handling bar **40*a* attract and hold a workpiece W to be pressed which is positioned on the loading station 15, and the vacuum cups 44 mounted on the handling bar 40*b* attract and hold a workpiece W on the lower drawing die 20a. At the same time, the vacuum cups 44 mounted on the handling bar 40c attract and hold a workpiece W on the workpiece stock station 26, and the vacuum cups 44 mounted on the handling bars 40d, 40e attract and hold workpieces W respectively on the lower trimming die 22a and the lower punching die 24a**.

Thereafter, all of the handling bars 40a through 40e with the respective workpieces W held thereby are lifted by the lifting/lowering units 32. The feed bars 34 are moved downstream the distance P by the moving units 38. When the handling bars 40a through 40e have been moved to respective positions directly above the lower die 20a, the workpiece stock station 26, the lower dies 22a, 24a, and the unloading station 17, the vertically movable bars 30 are lowered to set the workpieces W on the lower die 20a, the workpiece stock station 26, the lower dies 22a, 24a, and the unloading station 17, respectively. Thereafter, the handling bars 40a through 40e are returned to the retracted positions A by the lifting/lowering units 32 and the feed bar moving units 38. The upper dies are then lowered with their die holders to press those workpieces W set on the respective lower dies 20a, 22a, 24a.

Figure 2:
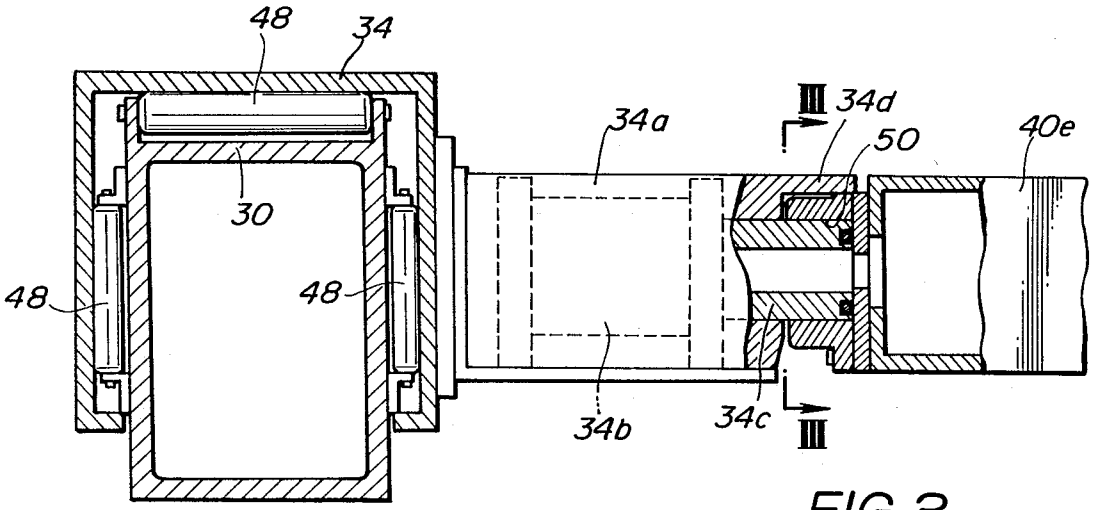
FIG. 2 is an enlarged cross-sectional view taken along line II—II of FIG. 1, showing the structure by which a feed bar and a handling bar are interconnected.
Figure 3:
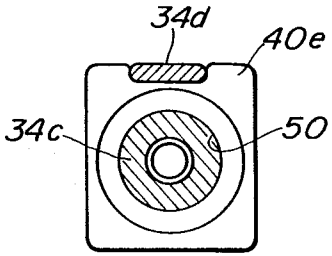
FIG. 3 is a cross-sectional view taken along line III—III of FIG. 2.

As shown in FIGS. 2 and 3, the feed bar 34 is rollingly movable on the vertically movable bar 30 by means of three rollers 48 and has a plurality of connectors 34a (only one shown in FIGS. 2 and 3) on an inner side thereof. In the connector 34a, there is mounted a cylinder 34b having an axially movable rod 34c. The handling bar 40e, for example, has a recess 50 defined in each of its opposite ends. When the rod 34c is extended, its tip end is inserted into the corresponding recess 50, thereby coupling the connector 34a and the handling bar 40e to each other. The connector 34a has a ridge 34d projecting from its distal end for engaging the handling bar 40a for limiting its height and rotation.

There are provided a total of ten handling bar gripping devices, generally designated by the reference numeral 52 (more specifically 52a through 52e) in FIG. 1. Four of the handling bar gripping devices are associated with the first mobile bolsters 11, whereas the remaining six handling bar gripping devices are associated with the second mobile bolsters 13. The handling bar gripping devices 52a through 52e are identical in structure. Therefore, one of the handling bar gripping devices 52e will be described in detail by way of example. As shown in detail in FIGS. 4 and 5, the handling bar gripping device 52e comprises a body 54 and a swing arm 56 angularly movably mounted on the body 54 by a support shaft 58 and gripping one end of the handling bar 40e, for example. More specifically, the body 54 of the handling bar gripping device 52e comprises two substantially V-shaped side plates 54a spaced from and parallel to each other, a bearing 54b joining the upper ends of the side plates 54a and supporting the opposite ends of the support shaft 58, and a bottom plate 54c joining the lower ends of the side plates 54a. The side plates 54a have slanted upper edges, respectively, to which there is secured an attachment plate 54d with a drive unit 60 fixedly mounted thereon.

The swing arm 56 comprises two spaced side plates 56a and is of a substantially V shape slightly smaller than the V-shaped configuration of the body 54, the swing arm 56 being coupled at its lower end to the support shaft 58. As indicated by the broken lines in FIG. 5, the swing arm 56 can be accommodated in a space between the side plates 54a of the body 54 during a pressing process. For detaching the handling bar 40e from the feed bar 34, the swing arm 56 is turned counterclockwise (FIG. 5) about the support shaft 58 to the solid-line position in order to support the handling bar 40e. The swing arm 56 is turned by the drive unit 60 which produces rotative power that is transmitted to the support shaft 58 by means of a power transmitting device. The power transmitting device comprises a sprocket 62 fixed to an output shaft 60a of the drive unit 60, a sprocket 64 fixed to one end of the support shaft 58, and a chain belt 66 trained around the sprockets 62, 64. The rotative power from the drive unit 60 is transmitted from the sprocket 62 through the chain belt 66 to the sprocket 64 for turning the support shaft 58 and hence the swing arm 56.

Two attachment plates 56b are coupled to and extend between upper portions of the side plates 56a. A hydraulic cylinder 70 is positioned between and supported on the attachment plates 56b by means of a plurality of support members 56c. The hydraulic cylinder 70 has an axially movable rod 72 with its distal end pivotally coupled to a bracket 74 fixed to a pivot pin 76. The pivot pin 76 has its opposite ends rotatably supoprted on the side plates 56a and coupled to ends of respective fingers 78. A support plate 80 is attached to the upper end of the swing arm 56. When the swing arm 56 is turned upwardly, the support plate 80 engages one of bearing plates 82 fixed to the respective opposite ends of the handling bar 40e. At this time, two positioning pins 84 on the support plate 80 are inserted into respective holes defined in the bearing plate 82 thereby to position the swing arm 56 with respect to the handling bar 40e. The hydraulic cylinder 70 is now operated to retract the rod 72 for thereby turning the fingers 78 into pressing engagement with the upper surface of the bearing plate 82 to press the bearing plate 82 downwardly against the support plate 80. The handling bar 40e is thus securely gripped and held in position by the swing arm 65.

Figure 6:
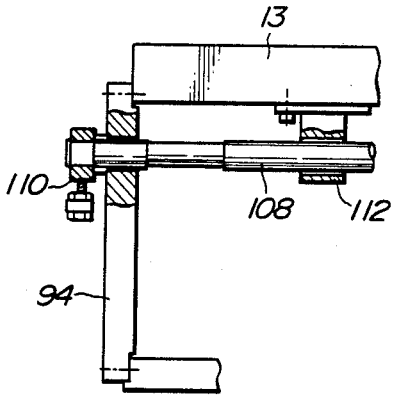
FIG. 6 is a cross-sectional view taken along line VI—VI of FIG. 4.

A tilting device, generally denoted at 90, serves to support and tilt each of the handling bar gripping devices 52 downwardly (FIG. 7) away from dies when the dies are to be changed. One of the tilting devices 90 which is associated with the second mobile bolster 13 and one handling bar gripping device 52e will be described below. The tilting device 90 has an attachment plate 94 fixed to a side of the second mobile bolster 13, a support shaft 92 having one end rotatably supported by a bearing on the attachment plate 94 and the other end rotatably supported by a bearing on a vertical plate 96 coupled to the attachment plate 94 by a horizontal plate 98, and a hydraulic cylinder 100 mounted on the vertical plate 96. The hydraulic cylinder 100 has an axially movable rod 102 coupled to the support shaft 92 by means of a swing arm 104. The support shaft 92 has a connector 106 to which the bottom plate 54c of the body 54 of the handling bar gripping device 52e is secured. The support shaft 92 is connected to one end of a transmission rod 108 through a link mechanism 110. As shown in FIG. 6, the transmission rod 108 is rotatably supported by a bearing 112 mounted on the lower surface of the second mobile bolster 13. The other end of the transmission rod 108 is coupled via a link mechanism (not shown) to the support shaft (not shown) of the opposite handling bar gripping device 52e.

Figure 4:
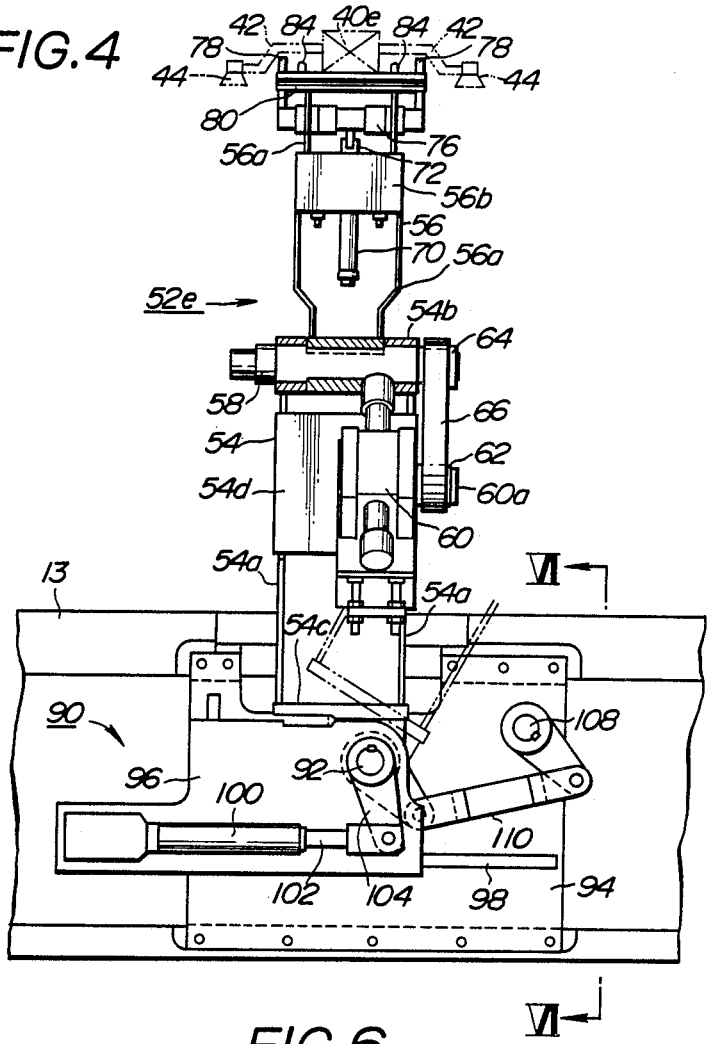
FIG. 4 is a front elevational view of a handling bar gripping device in the press machine shown in FIG. 1.

When the rod 102 is retracted from the position of FIG. 4, the swing arm 104 is turned clockwise and so is the support shaft 92 about its own axis. As the support shaft 92 is turned clockwise, the handling bar gripping device 52e is tilted to the right (FIG. 4) away from the dies as indicated by the broken lines. At this time, the rotation of the support shaft 92 is transmitted via the link mechanism 110 to the support shaft of the opposite handling bar gripping device 52e, which is therefore also tilted in the same direction.

A process of carrying the handling bars from the press machine will hereinafter be described. The handling bars 40a through 40e located in their respective retracted positions A after a pressing process are lowered a prescribed distance by the lifting/lowering units 32. Then, the die holder holding the upper die 24b is lowered, and the upper and lower dies 24b, 24a are aligned and mated with each other. Thereafter, the upper die 24a is released from the die holder thereof and placed on the lower die 24a.

Figure 5:
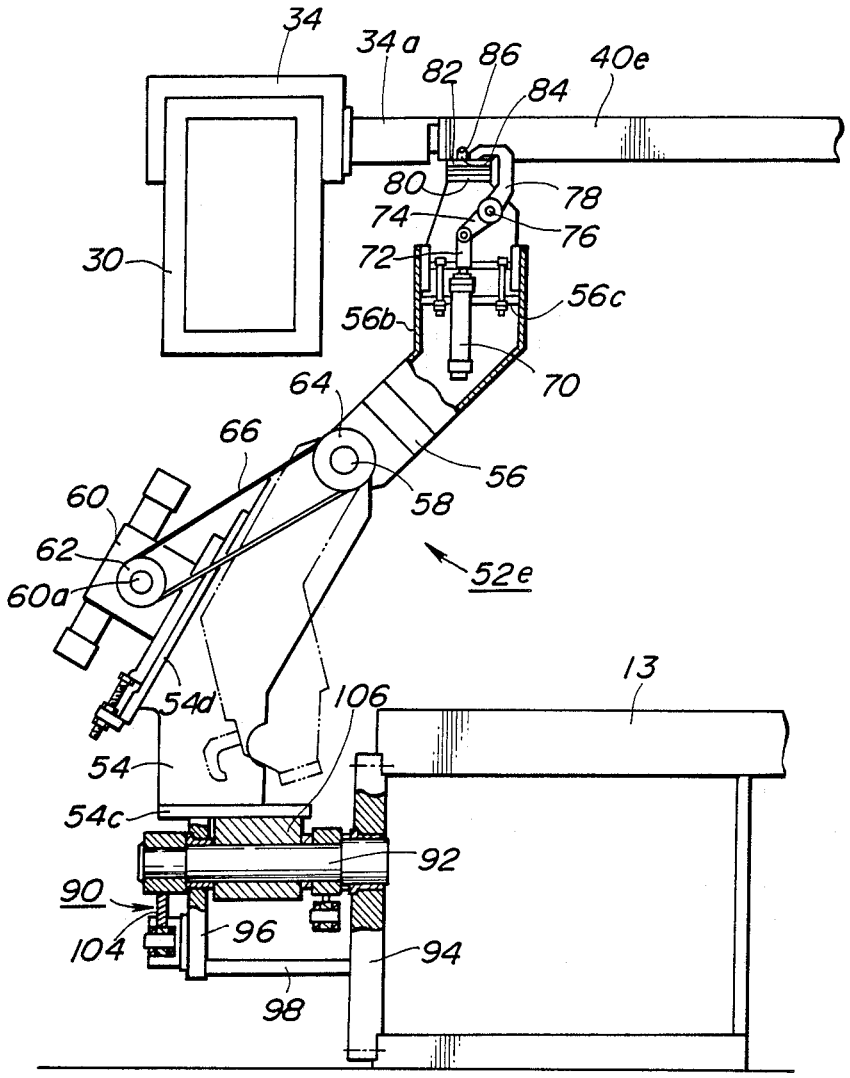
FIG. 5 is a side elevational view, partly in cross section, of the handling bar gripping device illustrated in FIG. 4.

Each of the handling bar gripping device 52e is operated in the manner described above to turn the swing arm 56 from the broken-line position to the solid-line position for gripping the handling bar 40e, as shown in FIG. 5. Thereafter, the rod 34c of the cylinder 34b is retracted to disconnect the connector 34a of the feed bar 34 from the handling bar 40e. The handling bar 40e is now released from the feed bar 34, and only held by the handling bar gripping device 52e. The vertically movable bar 30 is lifted to a position out of physical interference with movement of the handling bar 40e and/or the dies 24a, 24b, and the second mobile bolster 13 is moved along the guide rails 9 to deliver the upper and lower dies 24a, 24b, the handling bar 40e, and the handling bar gripping devices 52e out of the press machine 1. The other dies 20a, 20b,22a, 22b together with their associated parts are also delivered out of the press machine 1 in the same manner.

Figure 7:
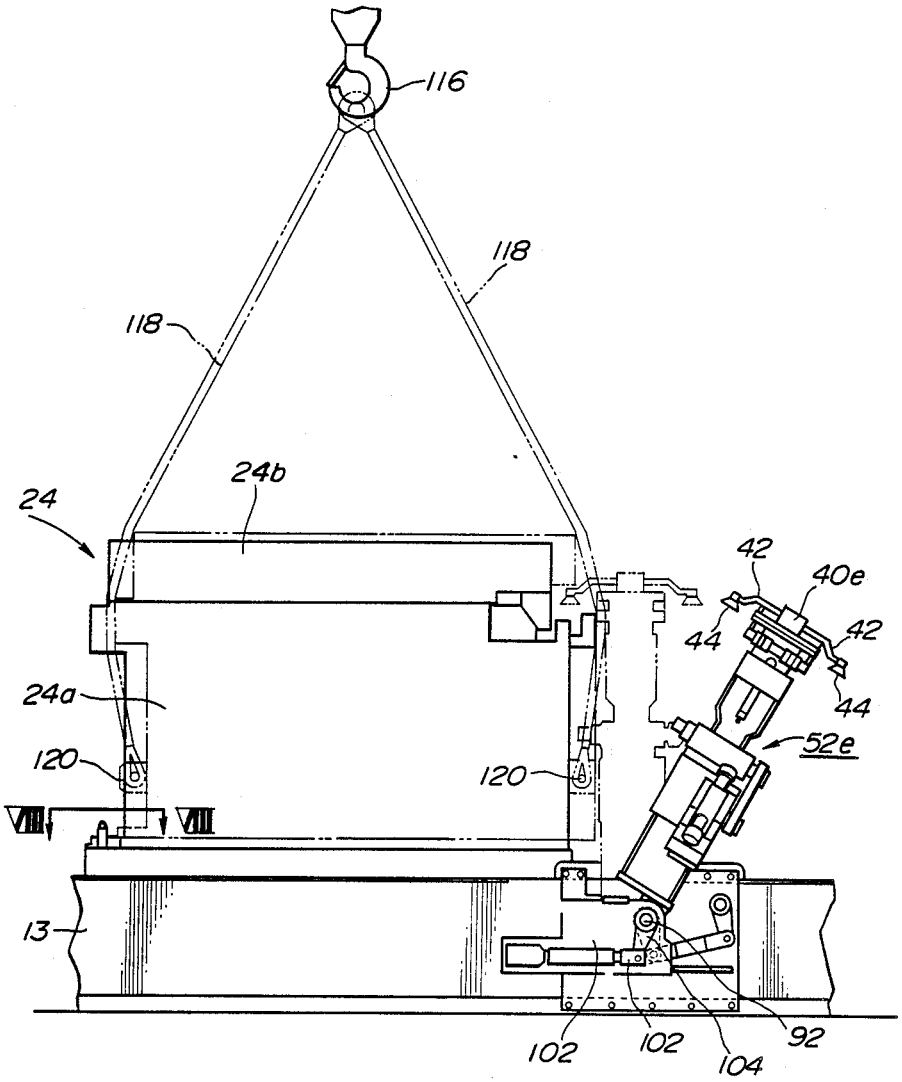
FIG. 7 is a fragmentary elevational view showing the manner in which the handling bar gripping device is tilted in preparation for replacing a workpiece holder.

Subsequently, the rod 102 of the hydraulic cylinder 100 of each of the tilting devices 90 is retracted to turn the support shaft 92 clockwise to tilt the handling bar gripping device 52 in a direction away from the dies 24a, 24b, which jointly constitute a punching die assembly 24, as shown in FIG. 7. The die assembly 24 is then carried away from the second mobile bolster 13 by suitable means. Then, the handling bar gripping devices 52d located just downstream of the upper and lower trimming dies or die assembly are tilted in the same manner as described above, and the trimming die assembly is carried away from the second mobile bolster 13. Finally, the handling bar gripping devices 52b located just downstream of the upper and lower drawing dies or die assembly are tilted in the same manner as described above, and the drawing die assembly is carried away from the first mobile bolster 11.

Thereafter, the support members 42 are removed from each of the handling bar gripping devices 52, and the workpiece holders or vacuum cups 44 are replaced with new workpiece holders. After the workpiece holder replacement, a new die assembly is mounted in place of the former drawing die assembly on the first mobile bolster 11, and the rod 102 is extended to turn the swing arm 104 counterclockwise for returning the handling bar gripping devices 52b to their upstanding position. Then, a new die assembly is mounted in place of the former trimming die assembly on the second mobile bolster 13, and the handling bar gripping devices 52d are returned to their upstanding position. Finally, a new die assembly is mounted in place of the former punching die assembly on the second mobile bolster 13, and the handling bar gripping devices 52e are returned to their upstanding position. The workpiece holders may be replaced with new ones before the die assemblies are replaced, i.e., immediately after the handling bar gripping devices are tilted.

Figure 8:
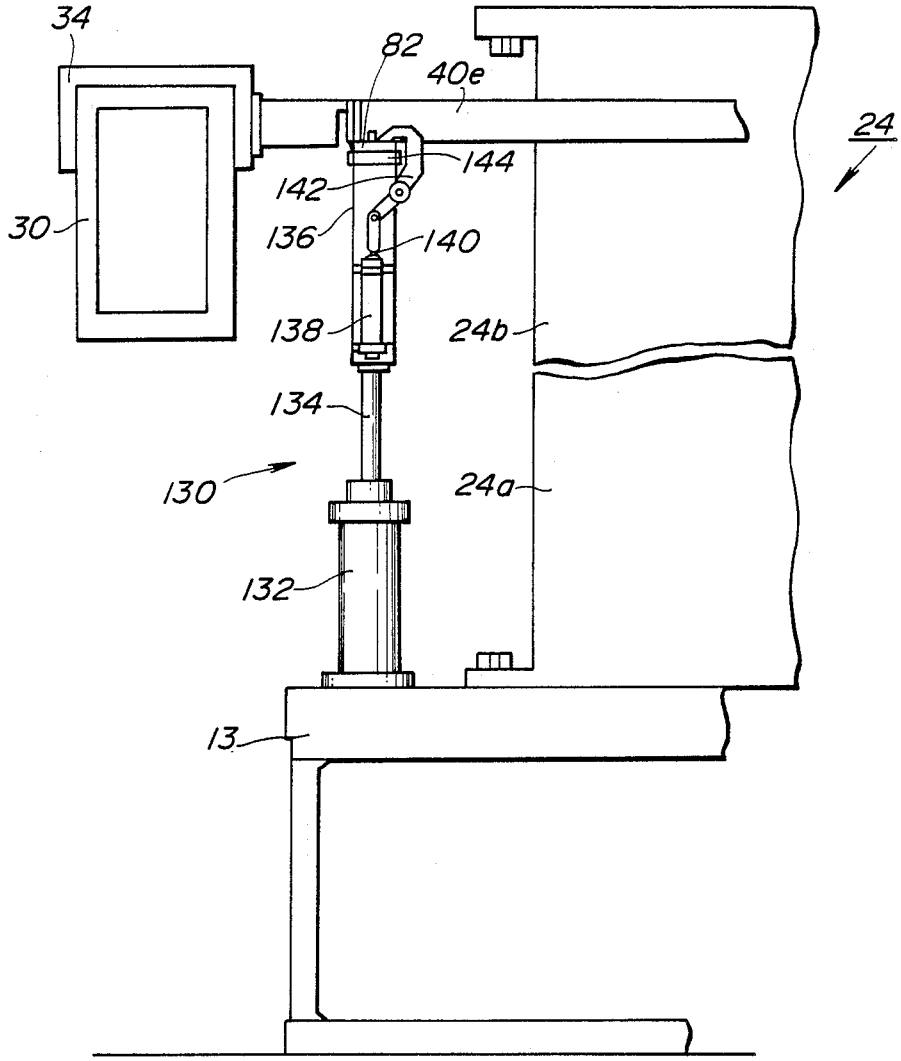
FIG. 8 is a fragmentary side elevational view of a handling bar gripping device according to another embodiment of the present invention.

According to another embodiment of the present invention, as shown in FIG. 8, a handling bar gripping device 130 is disposed on the second mobile bolster 13 at a position out of physical interference with the die assembly 24 as it is taken into and out of the press machine. The workpiece holders 44 can be replaced with new ones without tilting the handling bar gripping device 130 with respect to the die assembly 24. The handling bar gripping device 130 which is vertically mounted on the second mobile bolster 13 comprises a hydraulic cylinder 132 including a vertically movable rod 134 and a handling bar support member 136 coupled to the rod 134. The handling bar support member 136 has a small-size hydraulic cylinder 138 disposed therein and including a rod 140 joined to a finger 142 through a suitable joint.

In operation, after a given pressing process is completed, the hydraulic cylinder 132 is operated to extend the rod 134 upwardly until the upper surface of the handling bar support member 136 abuts against the handling bar 40e. Thereafter, the small-size hydraulic cylinder 138 is actuated to turn the finger 142 for pressing the bearing plate 82 attached to the handling bar 40e against a support plate 144 mounted on the handling bar support member 136. The handling bar 40e is thus firmly gripped in place by the handling bar gripping device 130.

Although there have been described what are at present considered to be the preferred embodiments of the present invention, it will be understood that the invention may be embodied in other specific forms without departing from the spirit or essential characteristics thereof. The present embodiments are therefore to be considered in all aspects as illustrative, and not restrictive. The scope of the invention is indicated by the appended claims rather than by the foregoing description.

We claim:

1. A method of changing workpiece holders detachably mounted on handling bars for holding workpieces in a press machine, said press machine including at least one mobile body, a plurality of die assemblies mounted on said mobile body, handling bar moving means for moving said handling bars from die assembly to die assembly, and handling bar gripping devices for gripping said handling bars, said method comprising the steps of:

(a) gripping said handling bars with said handling bar gripping devices;

(b) releasing said handling bar moving means from said handling bars;

(c) elevating said handling bar moving means beyond said die assemblies;

(d) moving said mobile body out of said press machine;

(e) tilting said handling bar gripping devices from a substantially vertical direction away from said die assemblies; and (f) detaching said workpiece holders from said handling bars and attaching new workpiece holders to said handling bars.

2. A method of changing workpiece holders used in a press machine for simultaneously pressing a plurality of workpieces, said press machine including at least one mobile body movable with respect to the press machine, a plurality of die assemblies mounted on said mobile body and arranged in a row along a direction in which the workpieces can be transferred through the press machine, a plurality of handling bars movable by handling bar moving means for transferring said workpieces successively through said die assemblies, lifting/lowering means for vertically moving said handling bar moving means, a plurality of workpiece holders detachably mounted on said handling bars for holding said workpieces, a plurality of handling bar gripping devices mounted on said mobile body for gripping said handling bars, and tilting means for tilting said handling bar gripping devices from a substantially vertical direction, said method comprising the steps of:

(a) gripping said handling bars with said handling bar gripping devices;

(b) releasing said handling bar moving means from said handling bars;

(c) elevating said handling bar moving means beyond said die assemblies with said lifting/lowering means;

(d) moving said mobile body out of said press machine;

(e) tilting said handling bar gripping devices from a substantially vertical direction away from said die assemblies with aid tilting means; and (f) detaching said workpiece holders from said handling bars and replacing the workpiece holders with new workpiece holders.

3. A method of changing workpiece holders for transferring workpieces from one die assembly to another in a press machine, said press machine including at least one mobile body on which the die assemblies are arranged in adjacent relation to one another, said mobile body being movable transversely to the press machine, a plurality of lateral handling bars to which said workpiece holders are detachably mounted, means for moving said handling bars between the die assemblies, said means including a pair of elongated bars extending through the press machine and placed near both sides of the die assemblies, said pair of bars being vertically movable by lifters, and a corresponding pair of feed bars extending through the press machine and slidably mounted on said bars, each of said lateral handling bars being detachably connected between the feed bars, and a plurality of pairs of handling bar gripping devices mounted on said mobile body and adapted to grip near opposite ends of the handling bars, said method comprising:

(a) gripping said handling bars by said handling bar gripping devices;

(b) disconnecting said handling bars from the feed bars;

(c) moving said vertically movable bars together with said feed bars upwardly of the die assemblies;

(d) moving said mobile body together with said handling bar gripping devices out of said press machine; and (e) detaching said workpiece holders from said handling bars and replacing them with new workpiece holders.

* * * * *